US007758437B1

(12) United States Patent
Stewart

(10) Patent No.: US 7,758,437 B1
(45) Date of Patent: Jul. 20, 2010

(54) GOLF SWING TRAINING AID

(75) Inventor: Glenn Stewart, Dallas, TX (US)

(73) Assignee: Spirit Merchandising Group, LLC, Carrollton, TX (US)

( * ) Notice: Subject to any disclaimer, the term of this patent is extended or adjusted under 35 U.S.C. 154(b) by 0 days.

(21) Appl. No.: 12/362,794

(22) Filed: Jan. 30, 2009

(51) Int. Cl.
*A63B 69/36* (2006.01)

(52) U.S. Cl. ..... 473/212; 473/276; 473/409

(58) Field of Classification Search ..... 473/207, 473/212, 219, 227, 256, 266, 276, 409; 482/122, 482/129
See application file for complete search history.

(56) References Cited

U.S. PATENT DOCUMENTS 4,896,887 A * 1/1990 Cable ..... 473/212
5,145,179 A * 9/1992 Breed ..... 473/212
5,203,567 A 4/1993 Erlinger et al.
5,711,716 A 1/1998 O'Brien et al.
5,735,776 A 4/1998 Swezey et al.
5,839,968 A 11/1998 Latella
5,902,189 A * 5/1999 Schultz ..... 473/212
5,904,624 A 5/1999 Martinez
6,176,790 B1 1/2001 Latella
7,033,282 B1 4/2006 Flood
7,585,229 B2 * 9/2009 Kelley ..... 473/276
2004/0219988 A1 11/2004 Park et al.
2008/0119299 A1 5/2008 Merrill

* cited by examiner

*Primary Examiner*—Nini Legesse
(74) *Attorney, Agent, or Firm*—Salter & Michaelson

(57) ABSTRACT

A method and apparatus for a golf swing training that assists a trainee or golfer in improving their golf swing. The apparatus includes a device supported between the forearms of the trainee or golfer during the golf swing. The dimensions of the device are selected so the device can be supported in relationship to the arms of trainee in the same configuration as the relationship of the arms during a natural and proper golf swing. By supporting the golf training apparatus between the forearms, the golf training apparatus induces the trainee or golfer to maintain the forearms, and importantly, the wrists, in a "quiet state" that produces a more effective golf swing.

33 Claims, 9 Drawing Sheets

GOLF SWING TRAINING AID

FIELD OF THE INVENTION

The present invention relates to a golf swing training aid and an associated method of use of the training aid. The present invention pertains to both a method for improving a golf swing and an associated apparatus to be used during training to improve the golf swing.

BACKGROUND OF THE INVENTION

Some golf training methods and apparatus appear to overcomplicate the functions of the golf swing and the preferred club positioning. For example, U.S. Pat. No. 7,033,284 to Yoshimura discloses an elaborate golf stroke correcting device that comprises an arm device formed with five frames, a plurality of arm pads and a golf club fixing device for attaching a golf club to the stroke correcting device. Further, Yoshimura discloses that the golf stroke correcting device has multiple functions including: (1) adjusting a distance between right and left arms; (2) adjusting a positional relation between right and left arms; (3) adjusting an angle in the arm device; (4) adjusting an angle formed by an arm device and a golf club fixing device; and (5) adjusting an angle formed by the arm device and the golf club.

As in Yoshimura discussed above, many background art golf swing training methods and apparatus depend upon use of a restraining device that physically limits the free range of movement of some part of the trainee's body. Such methods and apparatus offer some risk of injury since they often use some type rigid physical restraint (e.g., frames, arm pads) to impose a limit on some movement that is currently a part of the trainee's golf swing.

Alternatively, other golf training methods and apparatus typically underestimate the importance of consistent physical mechanics and how use of these mechanics can affect the desired golf swing. For example, U.S. Pat. No. 5,839,968 to Latella discloses a club swinging training method and apparatus that uses pliable body spacer objects, such as balls of varying sizes, weights and pliability, which are placed between the limbs. In particular, Latella discloses the use of a medicine ball that is gripped between the elbows. More specifically, Latella discloses a method where the trainee "squeezes" a ball weighing between 0.4 and 0.5 kg with his elbows throughout the golf swing. In some of the exercises which are described in Latella a golf club or a simulated club is actually moved as in a swing. However there is no indication that the training includes actually striking a golf ball. Further, Latella and other similar background art require the trainee to use muscles in one way during training (e.g., squeezing a ball between the trainee's elbows) and in a different way during an actual golf swing. The variability of the positioning of one's limbs and tensioning of one's muscles from training session to training session with such background art methods and apparatus can make it difficult to obtain consistent and repeatable improvement in a trainees golf swing.

Reference is also made to pending application Ser. No. 11/572,385 which is commonly owned by the present assignee and which describes an improved golf swing training aid. The entire contents of Ser. No. 11/572,385 is hereby incorporated herein by reference.

Therefore, there is a need in the art for a method and apparatus for golf swing training that allows a trainee or golfer to strive for developing and maintaining an improved golf swing without requiring complex training apparatus and that provides consistent utilization of the muscles and positioning of the limbs during both golf training swings and actual golf swings. Such a golf swing training method and apparatus should be simple to use and preferably employ an inexpensive and portable device as the training apparatus, and yet one that can be readily mounted to the golfer without restricting the golf swing.

SUMMARY OF THE INVENTION

The present invention relates to a method and associated apparatus for a golf swing training aid that assists a trainee or golfer in improving their golf swing. The apparatus of the present invention comprises a device designed to be supported between the forearms of the trainee or golfer during the golf swing. At least some, if not all of the practice swings using the apparatus and method of the invention includes actually striking a golf ball. The dimensions of the device are selected so the device can be supported in relationship to the arms of the trainee in the same configuration as the relationship of the arms during a natural and proper golf swing. By supporting the golf training apparatus between the forearms, the golf training apparatus induces the trainee or golfer to maintain the forearms, and importantly, the wrists, in a "quiet state" that produces a more effective golf swing. That is, supporting the golf training apparatus between the forearms of the trainee or golfer makes it difficult or impossible for the trainee or golfer to: (1) snap the head into the ball; or (2) twist the club in an effort to contact the ball from below. Thus, using the golf training apparatus helps to improve the loft of the ball. By practicing with the device, the users "muscle memory" records the "feel" of the positioning and manipulation of the arms and wrists. This "muscle memory" assists the user when swinging the club without use of the device.

One embodiment of the invention is a golf swing training apparatus comprising: a device configured to include channels arranged to accept the user's forearms. The channels are located in different regions of the device to accept forearms of a trainee, wherein, the device is of a shape, color, size and weight such that the trainee naturally maintains the position of their limbs and muscles while engaged with the device during a golf swing. Preferably, a first color or type region and a second color or type region are located on a surface of the device in different regions of the device. Preferably, a center line of the device is located between the forearm accepting channels of the device and define the demarcation between the first and second regions.

In another aspect, the present invention provides a method for improving a golf swing, comprising: positioning a golf training apparatus between a trainee's forearms; gripping a handle of a golf club such that a center line of the golf training apparatus is: positioned between the trainee's forearms, aligned with a center line of the trainee, and aligned with the handle of the golf club; swinging the golf club in a backward direction until only a first color or type region of the golf training apparatus is visible; and swinging the golf club in a forward direction until only a second color or type region of the golf training apparatus is visible.

BRIEF DESCRIPTION OF THE DRAWINGS

The present invention is now described in further detail as to a preferred embodiment thereof with the aid of the following drawings, in which.

DETAILED DESCRIPTION

The apparatus of the present invention comprises a part spherical or part near-spherical device. In two specific regions of the device the surface significantly departs from a spherical surface. In each of those regions the surface displays a channel for accepting the forearm, or in an alternate arrangement, the leg of a trainee or a golfer. One form of the apparatus is constructed by taking a part spherical or part near-spherical blank and modifying it by removing portions of the blank or its surface to provide for two forearm accepting channels on different hemispheres of the blank. A different method of construction is to create a mold encompassing a volume which is generally spherical or part-spherical or near spherical but departs from that form in two distinct regions. In each of these regions the surface of the volume significantly departs from a spherical surface. In each region the surface of the volume displays a channel that is suitable for accepting a forearm or leg of a trainee or golfer. The mold is then employed to create the apparatus by filling the mold with a material selected to solidify into the desired form.

Figure 3:
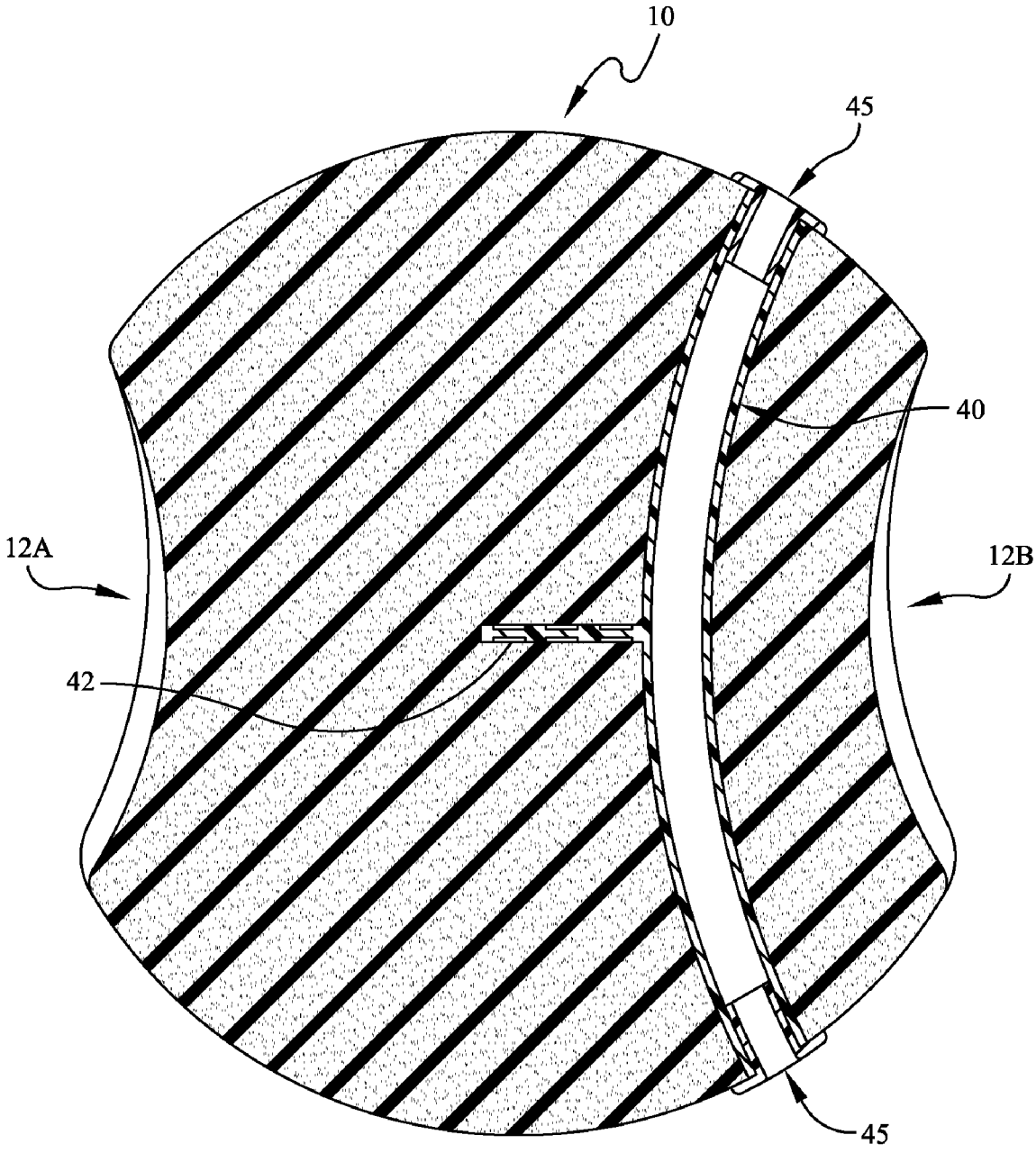
FIG. 3 is a cross-sectional view taken along line 3-3 of FIG. 2 and illustrating the opposed channel regions of the golf training apparatus.
Figure 4:
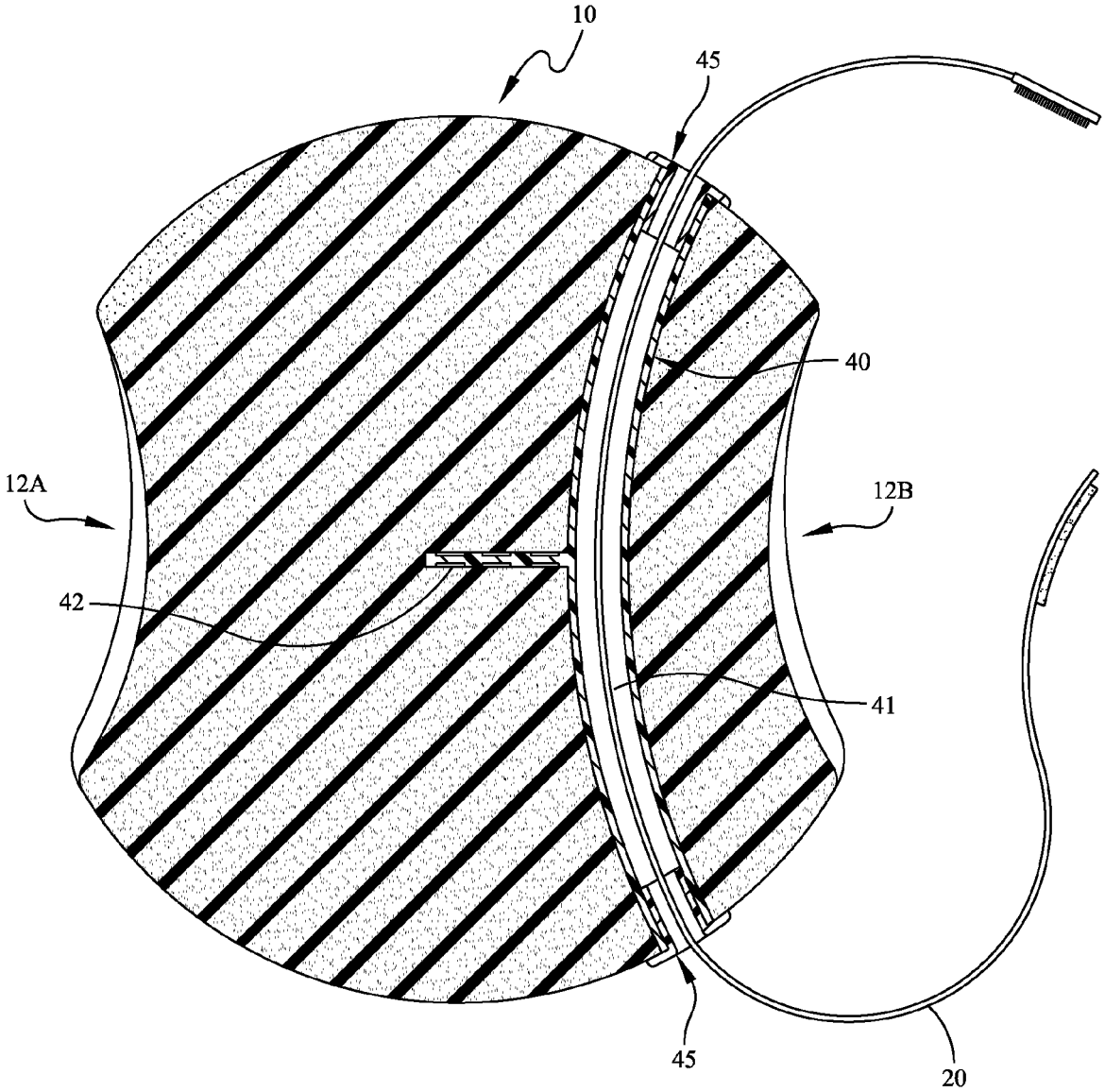
FIG. 4 is a cross-sectional view like that shown in FIG. 3 with the added securing strap.

FIGS. 3 and 4 depict cross-sectional views of the material of the spherical or near spherical apparatus or device. The material may be formed from a foam material such as a polyethylene foam that has a sufficient firmness to it so that it does not have any substantial deformity when held by the user. In that way the apparatus maintains a shape, weight and size when the apparatus is engaged by or held by the user.

A primary goal of the present invention is to simplify the process of practicing swinging a golf club at a golf ball without crowding and confusing the swing training with thoughts of the mechanics involved. Using the present invention, the required mechanics are mastered through a training regimen that repeats the swing over and over again until it becomes natural. Swinging a golf club based on positioning your limbs and tensioning your muscles in what has become natural through training provides results that are much better than when one attempts to swing a club while concentrating on the supposed mechanics of a golf swing. The present invention bridges the gap between mechanics and the natural feeling obtained through swing training and allows trainees or golfers to make strides in their skill level.

The present invention creates a natural and ideal relationship between the torso, the hands, wrists, forearms and the club as the club is moved through the swing and into the impact area with the golf ball. This inter-relationship between the above-discussed components is the one constant goal of all low handicap and Golf Professionals. However, this inter-relationship is typically not evident in over 90% of all golfers in the mid to high handicap range. Most of these individuals are flatfooted with the club head leading through impact with a golf ball. The result is a golf swing that produces no distance, inconsistent club face angle, and topped or fat shots. The method and apparatus of the present invention takes the trainee's focus away from trying to affect the golf ball and places the focus squarely on the trainee's body and club working together and through the golf ball.

Figure 1:
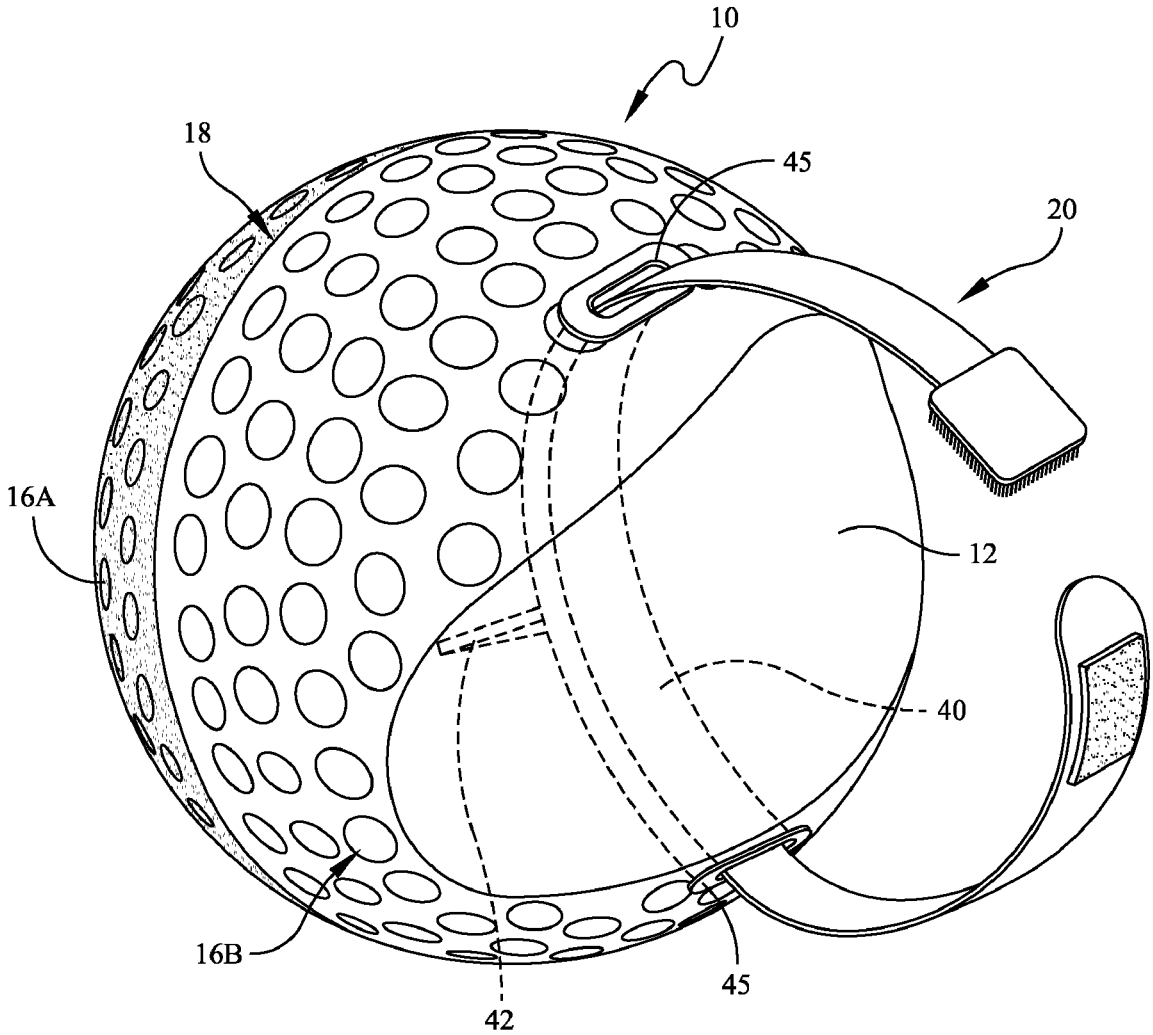
FIG. 1. Is a perspective view of one embodiment of a golf training apparatus constructed in accordance with the present invention.

FIG. 1 is a perspective view showing one embodiment of a golf training apparatus 10 constructed in accordance with the principles of the present invention. As shown in FIG. 1, the golf training apparatus 10 has a shape that is at least one of spherical, part spherical or part near-spherical. The shape of the golf training apparatus 10 includes opposed channels 12 to accept the forearms of the trainee or golfer when engaging the golf training apparatus 10. FIGS. 3 and 4 show the channels as channels 12A and 12B. The golf training apparatus 10 is fabricated from lightweight material, such as the aforementioned polyethylene foam, and preferably weighs in the range of about 0.17 kg (i.e., 6 ounces) to about 0.28 kg (i.e., 10 ounces) or one pound. The diameter of the golf training apparatus is in the range of about 10 cm to about 25 cm. Preferably, different diameter aids can be used depending upon the size of the golfer.

Non-limiting examples of other lightweight materials include, but are not limited to, foam rubber, plastic, paper and paper derivatives, which may be solid, hollow or substantially hollow. In one form of manufacture a suitable blank of the lightweight material is modified by cutting channels in the surface to accept a user's forearms. The original blank and the size and orientation of the channels are an appropriate shape, size and weight such that, when in use the trainee or golfer is not aware of maintaining the position of the golf training apparatus during a golf swing. In other words, merely maintaining the apparatus in the proper position requires the user to maintain his hands, wrists and forearms in the appropriate position for a proper golf swing. In use the aid is constructed with sufficient firmness so that, when it is placed in position and held there, there is no substantial deformation of the aid.

Also, preferably the golf aid is held to the golfer by a strap means 20 (securing strap) as illustrated in further detail hereinafter. This securing strap is shown in FIGS. 9 and 10 as attached to the left arm of the user. However, it should be understood that it may also be attached to the right arm of the user. The attachment strap assists in holding the golf aid in the proper position which is with the aid between the forearms of the golfer or trainee.

FIGS. 2-5 show further details of the golf aid in the illustrated embodiment. As indicated before, the shape of an initial configuration has been modified to include forearm regions or channels 12A, 12B for accepting the forearms of the trainee or golfer. In addition, in FIGS. 1, 5 and 9 the golf training apparatus 10 is illustrated as further comprising two distinctive color regions 16A, 16B. The different color regions may be differentiated by the color of the surface of each region. For example, color region 16A may be darker in color than color region 16B or the reverse may be the case. Different color area may be provided. In addition to using different color regions, one may also use other different surface areas such as by using different surface textures. A centerline 18 between the two distinctive color regions 16A, 16B is located about the diameter of the golf training apparatus 10. Refer to the centerline 18 in FIGS. 1 and 5. Furthermore, the center line 18, as illustrated, is preferably located equally between the forearm regions or channels 12 of the golf training apparatus 1.

Figure 9A:
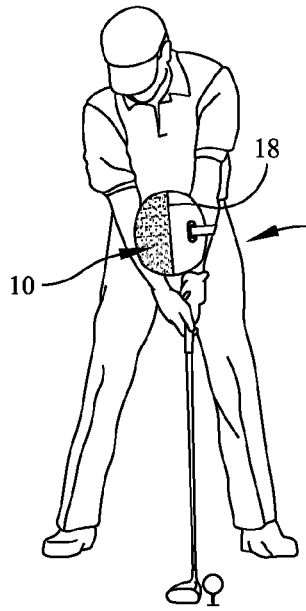
FIG. 9 shows a series of illustrations of the method of use of the golf training apparatus of the present invention.

Moreover, the centerline 18 of the golf training apparatus 10 is typically aligned with the handle of the golf club as the golf club is gripped by the trainee or golfer, and while the golf training apparatus 10 is engaged with the forearms of the trainee or golfer 30 as shown in FIG. 9A. In addition, the center line 18 of the golf training apparatus is preferably aligned with the center line of the trainee's body. An example of the trainee or golfer 30 using the golf training apparatus 10 is illustrated in the sequential positions shown in FIG. 9A to FIG. 9D.

As illustrated in FIG. 9A, the golf training apparatus 10 is located between the forearms of the trainee or golfer 30 as the golf club is gripped in preparation for a golf swing. In particular, by positioning the golf training apparatus 10 between the forearms of the trainee or golfer 30 this assists in providing a "quieting" of the wrist action of the trainee or golfer 30 during the impact of the golf club with the ball during a golf swing. Positioning the golf training apparatus 10 in this way forces the golfer to turn the body while impacting the golf ball instead of remaining on the back foot and snapping the wrists.

Figure 9B:
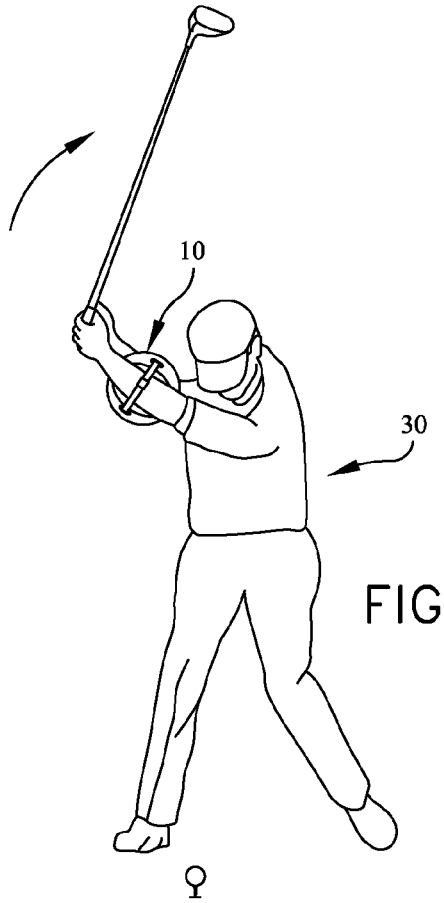
Figure 9C:
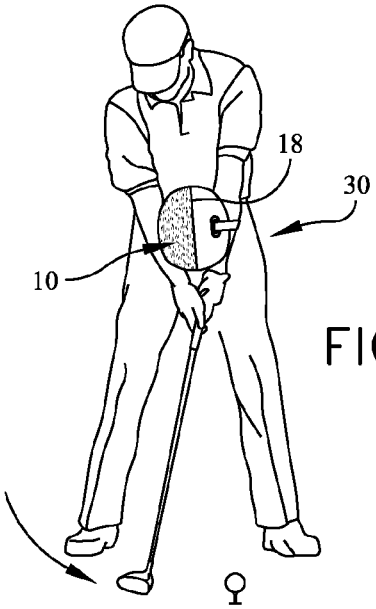
Figure 9D:
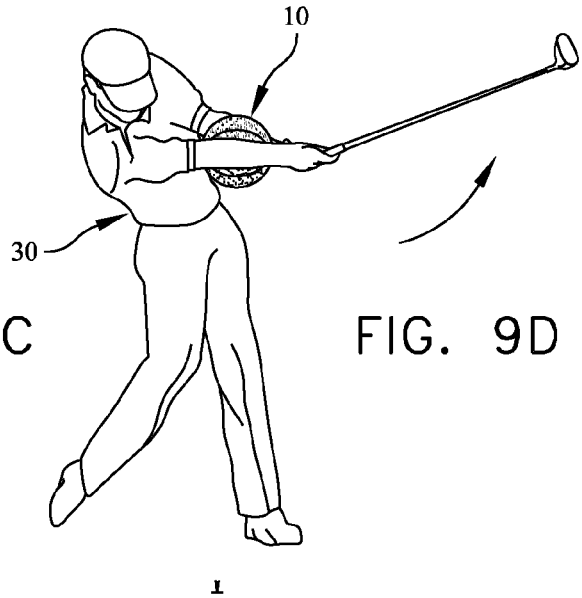
Figure 10A:
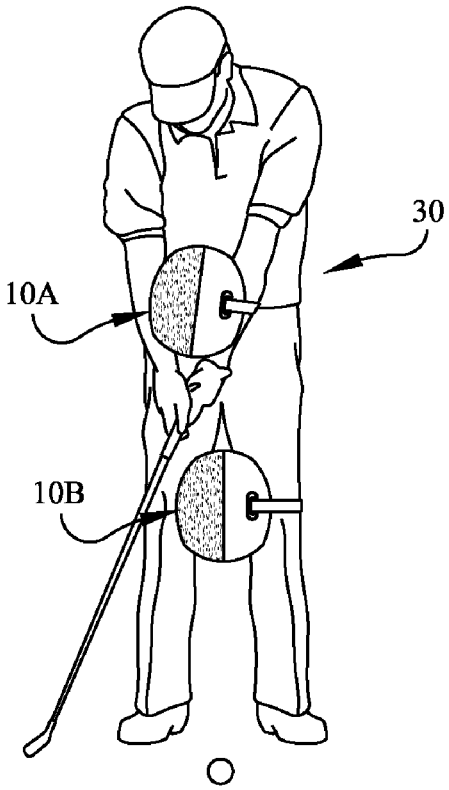
FIG. 10 shows illustrations of an alternate use of the method of the present invention.
Figure 10B:
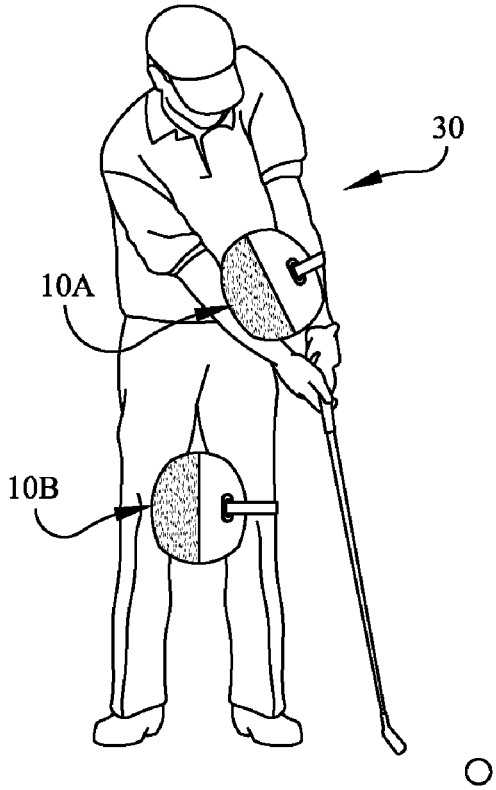

FIG. 9B to FIG. 9D further illustrate subsequent steps in the use of the golf training apparatus. Note that from the vantage point of an observer for FIG. 9B through FIG. 9D, the appearance of the apparatus 10 changes through the different phases of the swing. More particularly, when initially addressing the ball (FIG. 9A), both regions 16A and 16B are clearly visible as indicated by the sight of both of the different colors or types of the regions 16A and 16B. At the top of the swing (FIG. 9B), the trainee or golfer 30 has rotated both arms so that only one region 16B of the apparatus 10 is visible (i.e., only one of the two colored regions 16A, 16B is visible). Just prior to contact with the golf ball (FIG. 9C), both regions 16A, 16B are again visible; and as the stroke is completed (FIG. 9D) only one region 16A is visible.

The foregoing describes the appearance presented to an observer or instructor during a properly executed swing. Deviations from this presentation serve as a clue to an improper swing. The trainee or golfer 30 can also take advantage of the changing appearance of the apparatus at different times in a properly executed golf swing. More particularly, the trainee or golfer will also see both different colored regions of the apparatus as the ball is addressed (FIG. 9A). At the top of the backswing (FIG. 9B) and at the completion of the stroke (FIG. 9D) where the observer should see only one colored region, the trainee or golfer should see both regions.

Reference is now made to co-pending application Ser. No. 11/572,385 which is hereby incorporated herein by reference, and in particular to the flow charts shown therein illustrating the method of use of the apparatus of the present invention. This involves a method of using the golf training apparatus 10 for improving a golf swing. This method comprises positioning a golf training apparatus between the forearms of a trainee; gripping a handle of a golf club such that the axis or center line of the golf training apparatus is located between the forearms of the trainee and aligned with the axis or handle of the golf club; swinging the golf club in a backward direction until only a first color region of the golf training apparatus is visible to an observer; swinging the golf club in a forward direction until the swing/stroke is completed and only a second color region of the golf training apparatus is visible to the observer. Moreover, in one embodiment, the method of improving a golf swing includes all the steps leading up to swinging the golf club in the forward direction at least 5 times with a golf ball and at least 5 times without the golf ball. The method ends when at least 5 swings are completed with and without a golf ball.

Swinging the golf club in the backward direction may further comprise the steps of shifting the trainee's weight from a foot located forward of the center line of the trainee to a foot located behind the center line of the trainee; positioning the hands of the trainee at least one of chest high and three-quarters; and positioning the golf club over a shoulder located behind the center line of the trainee.

Swinging the golf club in the forward direction may further comprise the steps of shifting the trainee's weight from the foot located behind the center line of the trainee to a foot located forward of the center line of the trainee; positioning the golf club over a shoulder located forward of the center line of the trainee; and brushing the golf club against a ground surface as you rotate the golf training apparatus from a first color to a second color.

By using the method of the present invention, as discussed above, a trainee learns to rotate their forearms properly by swinging the golf club first in a backward and then a forward direction and by turning the golf training apparatus 10 such that: (1) only a first color region 16A of the golf training apparatus 10 is visible to an outside observer while swinging in the backward direction; and (2) as the swing is completed in the forward direction, only a second color region 16B of the golf training apparatus 10 is visible to the outside observer. That is, by making the two color regions 16A, 16B of the present invention distinctive, it is readily apparent to the outside observer or instructor whether or not the trainee is properly executing a golf swing upon impact. Again rather than different color regions, different other surface areas can be used as long as they are readily discernable one from the other.

Figure 6:
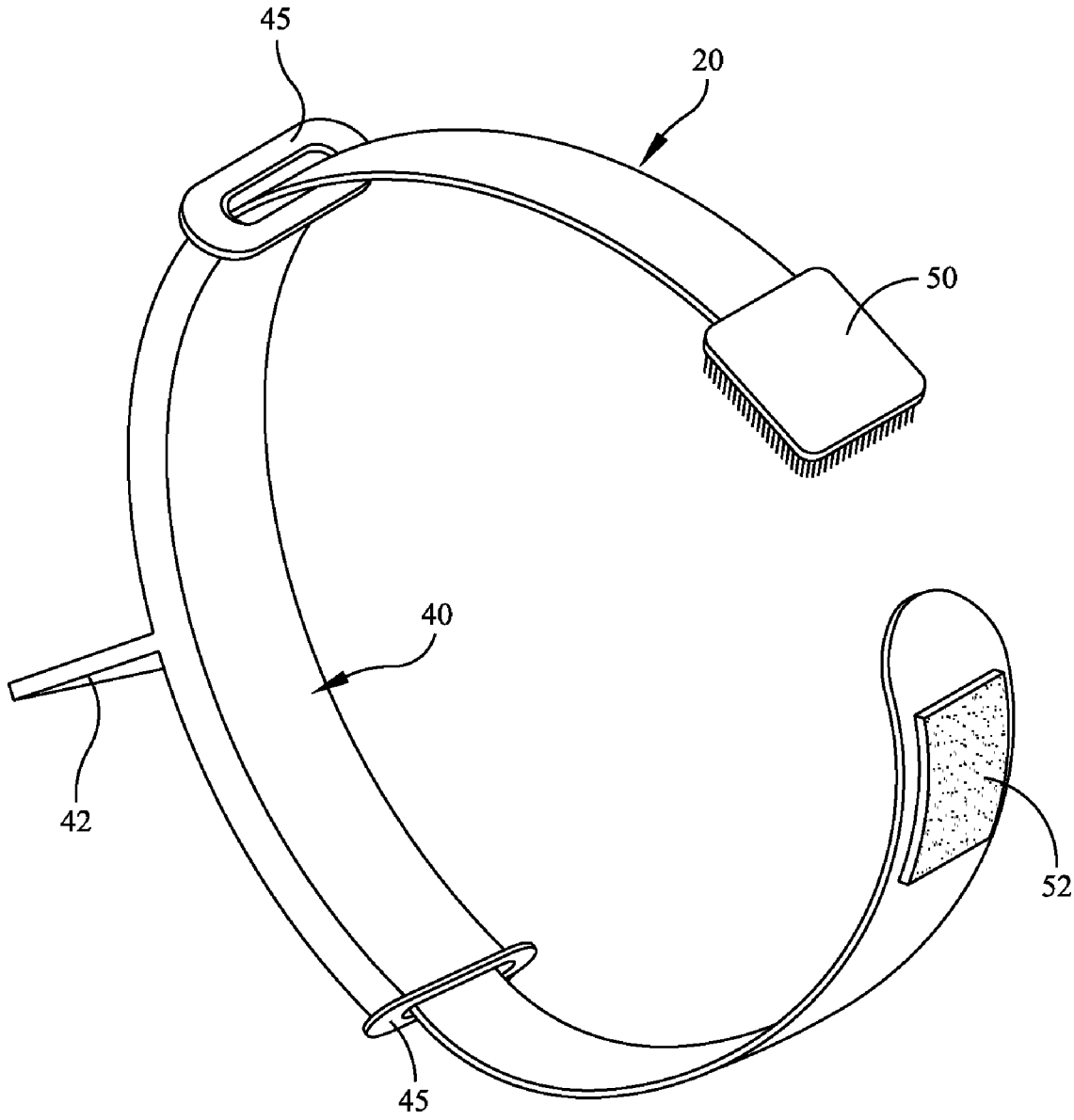
FIG. 6 is a perspective view of the securing strap and holder.
Figure 7:
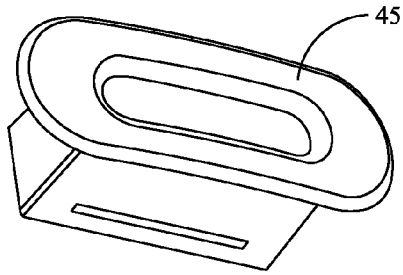
FIGS. 7 and 8 are perspective views of components of the holder of FIG. 6.
Figure 8:
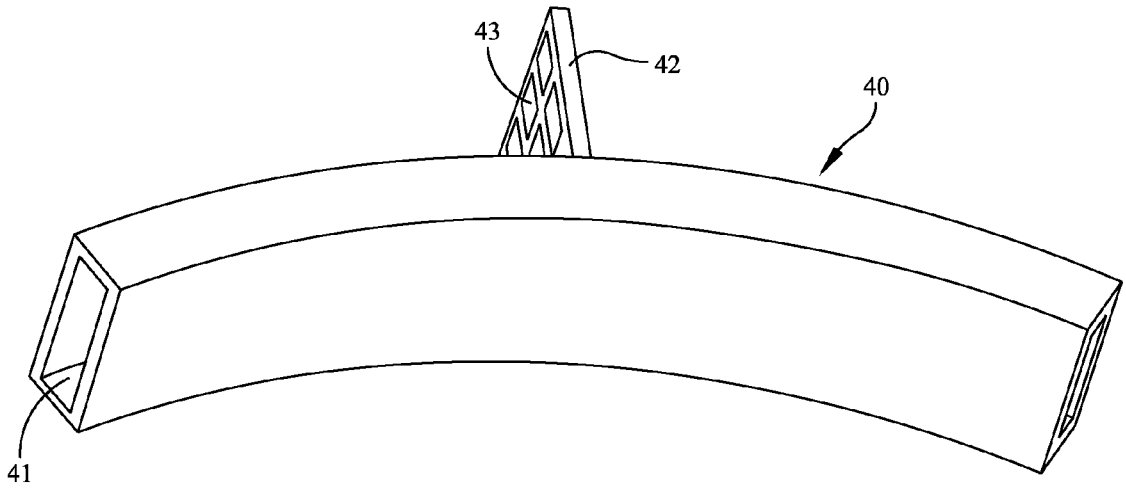

The drawings also show the preferred use of a securing strap 20 that is adapted for placement in the strap guide and holder 40. FIG. 6 is a perspective view of the strap 20 and holder 40 separate from the golf aid. FIGS. 1-4 show the strap 20 and holder 40 in position in the ball apparatus. The holder 40 defines a channel 41 for receiving the strap 20, and has one or more wing members 42 that assist in holding the holder 40 in place in the foam material as shown in FIGS. 3 and 4. The wing member 42 also preferably has a series of holes or indentations 43 therein that assist in holding the wing member 42 in place. The holder also includes end caps 45, as depicted in FIG. 7, and that define the opposite end ports of the holder, as positioned in FIG. 6. These end caps 45 engage at opposite ends of the circular shaped holder 40. The strap 20 is shown as having some type of an attachment piece at each end. Refer to FIG. 6. This is illustrated as a VELCRO type fastener 50, 52. However, other types of end fasteners may also be used.

Figure 5:
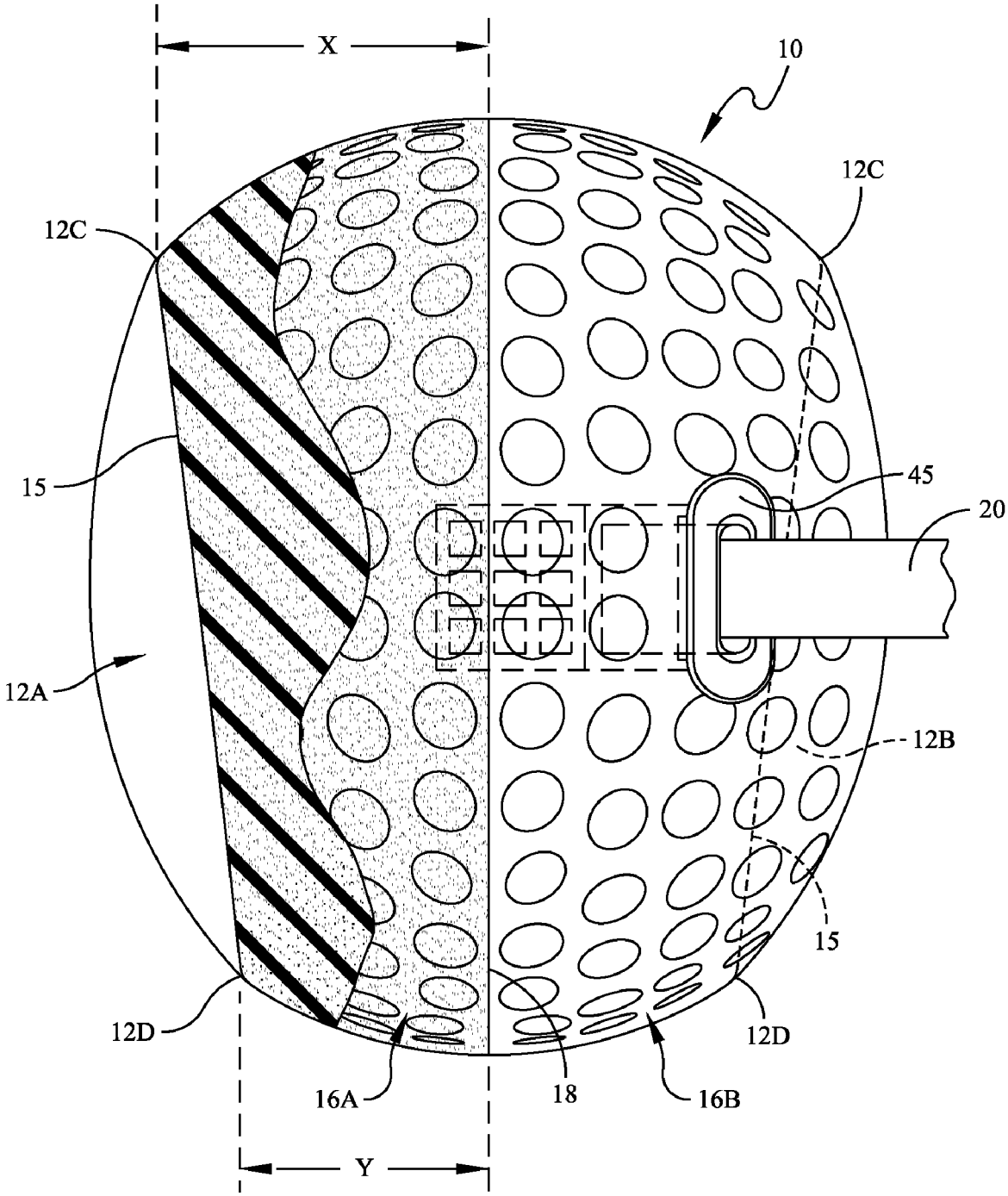
FIG. 5 is a transverse view that is partially cut-away of the golf training apparatus of the present invention as shown in FIGS. 1-4.

Another feature of the golf aid is the asymmetric nature of the channel regions within the separate hemi-spherical regions. This is observable, for example, in FIGS. 2, 5 and 9 where the oval shape tapers as at 15 in FIG. 5. This thus provides different dimensions at the ends of the oval shape at 12C and 12D relative to the centerline 18. These dimensions are shown in FIG. 5 at "X" measured from point 12C to the centerline 18 and comparatively smaller dimension "Y" measured from the point 12D to the centerline 18. This arrangement provides a comfortably fit with the forearms and also provides a proper positioning of the arms relative to the club and body. The forearms are further apart (dimension 2X) closer to the elbow and less apart (dimension 2Y) closer to the wrist.

Figure 2:
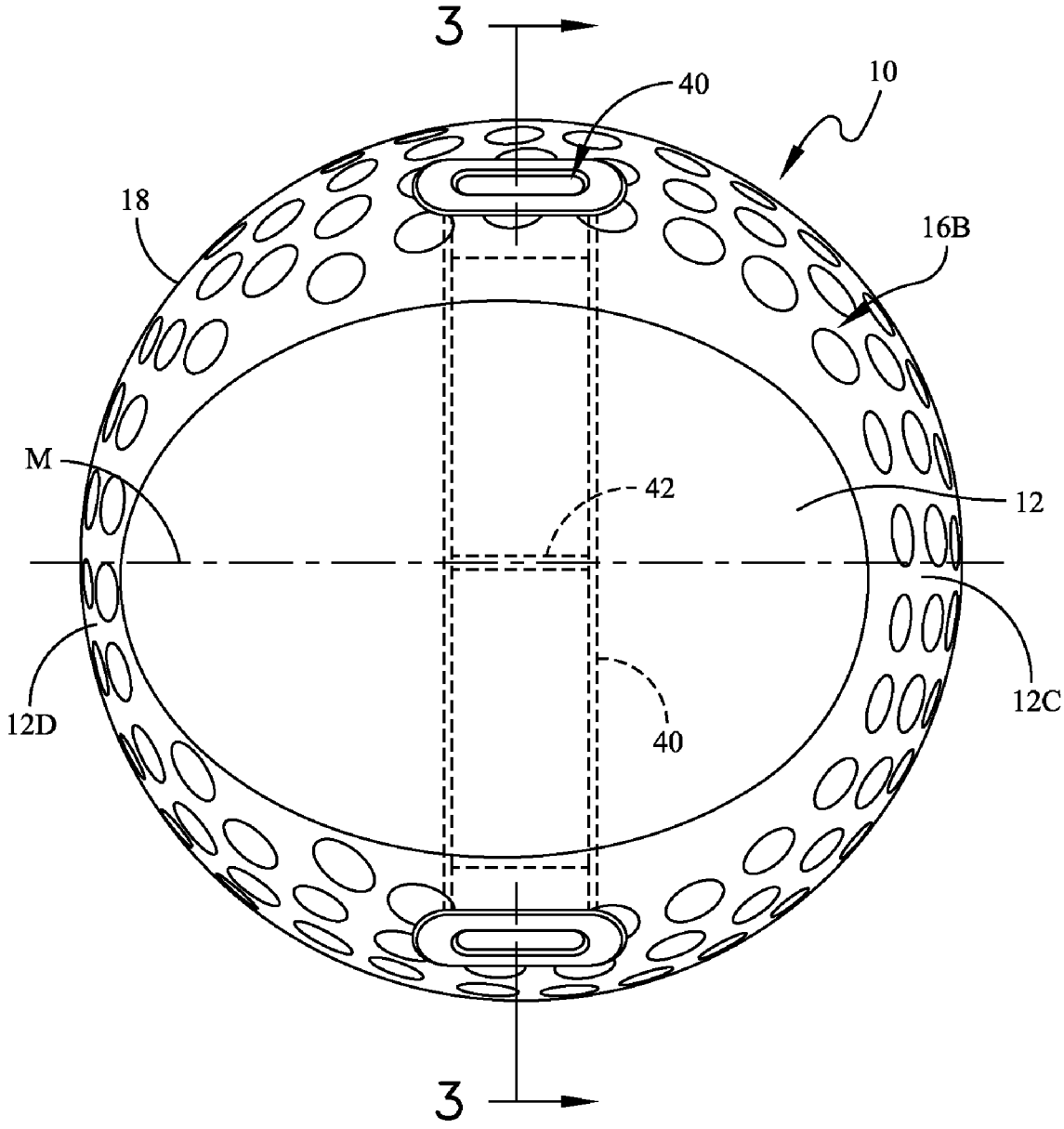
FIG. 2. May be considered as a front view of the golf training apparatus of FIG. 1 showing one of the channel region adapted for accepting the trainee's or golfer's forearms or legs.

FIG. 2 depicts the channel as basically oval or elliptical in shape. The end points along the major axis M of the ellipse are shown in FIG. 2 at 12C and 12D. Due to the asymmetric nature of the oval due to the taper at 15 the point 12C is further from the centerline 18 than the point 12D. As the channels are symmetrically disposed from side to side, in FIG. 5 the same dimensional points are also found at the opposed channel 12B. Thus, the distance between the channels at one end (12C) is 2X and at the other end (12D) is 2Y.

The foregoing description illustrates and describes the present invention. Additionally, the disclosure shows and describes only the preferred embodiments of the invention, but as mentioned above, it is to be understood that the invention is capable of use in various other combinations, modifications, and environments and is capable of changes or modifications within the scope of the inventive concept as expressed herein, commensurate with the above teachings and/or skill or knowledge of the relevant art. The embodiments described hereinabove are further intended to explain best modes known of practicing the invention and to enable others skilled in the art to utilize the present invention in such or other embodiments and with the various modifications required by the particular applications or uses of the invention. Accordingly, the description is not intended to limit the invention to the form or application disclosed herein. Also, it is intended that the appended claims be construed to include alternative embodiments.

What is claimed is:

1. A golf swing training apparatus comprising: a device configured to include forearm accepting channels located on different regions of the device, wherein, the device maintains a shape, size and weight such that a trainee naturally maintains the position or limbs and muscles while engaged with the device during a golf swing, wherein the different regions of the device are defined by a symmetric centerline that extends about the device and separates the device into the different regions; wherein each said channel is substantially elliptical in shape, and the elliptical channels are disposed along a taper having one and other ends so that one end of the taper is closer to the centerline than the other end of the taper.

2. The apparatus of claim 1, wherein the shape of the device is at least one of spherical, part spherical or part near-spherical and includes a securing means for mounting the apparatus to either arm of the user.

3. The apparatus of claim 2, wherein the separate regions include a first region and a second region that is visually discernable from the first region, both said regions being located on a surface of the device in different regions of the device.

4. The apparatus of claim 3, wherein the center line of the device is located about a diameter of the device and the first and second regions are different color regions.

5. The apparatus of claim 4, wherein the device has a diameter in the range of about 10 cm to about 25 cm.

6. The apparatus of claim 5, wherein the device is made from at least one of foam rubber, plastic, paper and paper derivatives.

7. The apparatus of claim 6, wherein the device is at least one of solid, hollow and substantially hollow.

8. The apparatus of claim 7, wherein the device weighs in the range of about 0.17 kg (i.e., 6 ounces) to about 0.28 kg (i.e., 10 ounces).

9. The apparatus of claim 1 including a strap and a holder for the strap, the strap being imbedded in the apparatus and having a passage for receiving the strap, the strap having end fasteners for mounting the strap about one of the arms of the user.

10. The apparatus of claim 9 wherein the strap extends in a direction of the minor axis of the ellipse.

11. The apparatus of claim 1 wherein the different regions are of different discernable type, and the one ends of both channels are closer to the centerline than the other ends of both channels.

12. A method for improving a golf swing, comprising:

positioning a golf training apparatus between a trainee's forearms gripping a handle of a golf club such that a center line of the golf training apparatus is:

positioned between the trainee's forearms, aligned with a center line of the trainee, and aligned with an axis of the handle of the golf club;

swinging the golf club in a backward direction; and swinging the golf club in a forward direction until a swing is completed;

wherein the apparatus maintains a shape, size and weight such that a trainee naturally maintains the position of limbs and muscles while engaged with the apparatus during a golf swing;

and wherein each said channel is formed as elliptical in shape, separate regions are defined by a centerline about the device, a single channel is disposed in each respective region, and the elliptical channels are disposed along a taper having one and other ends so that one end of the taper is closer to the centerline than the other end of the taper.

13. The method of claim 12, wherein the golf training apparatus is the golf swing training apparatus of claim 1.

14. The method of claim 13, wherein swinging the club in the backward direction further comprises positioning the hands of the trainee at least one of chest high and three-quarters high.

15. The method of claim 14, wherein swinging the golf club in the forward direction positions the golf club over a shoulder located forward of the center line of the trainee.

16. The method of claim 15, wherein swing the golf club in the forward direction is performed at least 5 times without a golf ball.

17. The method of claim 12, wherein the step of swinging the golf club in a backward direction is terminated when only a first color region of the golf training apparatus is visible and wherein the step of swinging the golf training apparatus in a forward direction is terminated when only a second color region is visible.

18. The method of claim 17, wherein swinging the club in the backward direction further comprises positioning the golf club over a shoulder located behind the center line of the trainee.

19. The method of claim 18, wherein swinging the golf club forward direction further comprises brushing the golf club against a ground surface while the golf training apparatus from a first color to a second color.

20. The method of claim 12, wherein swinging the golf club in the backward direction further comprises shifting the trainee's weight from a foot located forward of the center line of the trainee to a foot located behind the center line of the trainee.

21. The method of claim 20, wherein swinging the golf club in the forward direction further comprises shifting trainee's weight from the foot located behind the center line of the trainee to a foot located forward of the center line of the trainee.

22. The method of claim 21, wherein swinging the golf club in the forward direction is performed at least 5 times with a golf ball.

23. A golf swing training apparatus comprising: a device configured to include forearm accepting channels located on different regions of the device, wherein, the device maintains a shape, size and weight such that a trainee naturally maintains the position of limbs and muscles while engaged with the device during a golf swing, wherein the different regions of the device are defined by a symmetric centerline that extends about the device and separates the device into two distinct type regions; a holder imbedded in the device and having a through passage that extends between opposite open ends of the holder that are disposed at the same region; and a strap that extends through the holder passage and includes an attachment means for mounting the strap about one of the limbs of the user; wherein each said accepting channel is elliptical in shape, and the elliptical channels are disposed along a taper so that one end thereof is closer to the centerline than the other end thereof.

24. The apparatus of claim 23 wherein the holder is arcuate in shape and the ends of the passage terminate at respective locations on either side of the accepting channel.

25. The apparatus of claim 24 including end caps at respective ends of the holder.

26. The apparatus of claim 25 wherein the attachment means includes hook and loop fasteners.

27. A golf swing training apparatus comprising:

a device configured to include forearm accepting channels located on different regions of the device;

the device constructed and arranged so that a person using the device naturally maintains the position of limbs and muscles while engaged with the device during a golf swing;

the different regions of the device being defined by an annular centerline that extends about the device and separates the device into the different regions;

wherein each accepting channel is disposed along a taper having one and other ends so that one end of the taper is closer to the centerline than the other end of the taper; wherein each said accepting channel is substantially elliptical in shape.

28. The apparatus of claim 27 wherein the elliptical channels are both disposed along the taper so that one ends of both channels are closer to the centerline than the other ends of both channels.

29. The apparatus of claim 28 wherein each said accepting channel is substantially elliptical in shape with the major axis following the taper.

30. The apparatus of claim 28 including a holder imbedded in the device and having a through passage that extends between opposite open ends of the holder that are disposed at the same region; and a strap that extends through the holder passage and includes an attachment means for mounting the strap about one of the limbs of the user.

31. The apparatus of claim 30 wherein the holder is arcuate in shape and the ends of the passage terminate at respective locations on either side of the accepting channel.

32. The apparatus of claim 31 including end caps at respective ends of the holder.

33. The apparatus of claim 32 wherein the attachment means includes hook and loop fasteners.

* * * * *